US007461427B2

(12) United States Patent
Ronald et al.

(10) Patent No.: US 7,461,427 B2
(45) Date of Patent: Dec. 9, 2008

(54) BRIDGE CONSTRUCTION SYSTEM AND METHOD

(76) Inventors: Hugh D. Ronald, 35405 Stagecoach Trail, Eustis, FL (US) 32736; Don Theobald, P.O. Box 825, Pass Christian, MS (US) 39571-0825

( * ) Notice: Subject to any disclaimer, the term of this patent is extended or adjusted under 35 U.S.C. 154(b) by 527 days.

(21) Appl. No.: 11/271,883

(22) Filed: Nov. 14, 2005

(65) Prior Publication Data

US 2006/0117504 A1 Jun. 8, 2006

Related U.S. Application Data

(60) Provisional application No. 60/633,525, filed on Dec. 6, 2004.

(51) Int. Cl.
*E01D 21/00* (2006.01)

(52) U.S. Cl. ..... 14/77.1

(58) Field of Classification Search ..... 52/741.1, 52/745.18, 745.2; 414/10, 560; 14/77.1, 14/78

See application file for complete search history.

(56) References Cited

U.S. PATENT DOCUMENTS 4,497,153 A * 2/1985 Muller ..... 14/77.1
5,195,204 A * 3/1993 Muller et al. ..... 14/4
5,511,268 A * 4/1996 Albus et al. ..... 14/77.1
5,549,176 A * 8/1996 Hawkins ..... 182/63.1
5,628,582 A * 5/1997 Nagle ..... 404/6
5,966,764 A * 10/1999 Vodicka ..... 14/74.5
6,701,564 B2 * 3/2004 Snead ..... 14/77.1
6,721,985 B2 * 4/2004 McCrary ..... 14/77.1
7,013,520 B1 * 3/2006 Snead ..... 14/77.1
7,210,183 B2 * 5/2007 Kornatsky ..... 14/77.1
7,363,671 B2 * 4/2008 Snead ..... 14/77.1

* cited by examiner

*Primary Examiner*—Gary S Hartmann
(74) *Attorney, Agent, or Firm*—Juan J. Lizarraga

(57) ABSTRACT

A system and method for construction of bridges and elevated roadways with pre-stressed concrete or steel bridge girders is provided including cast-in-place concrete deck slabs and partial and full depth pre-stressed pre-cast concrete deck slabs with post-tensioning conduits for post-tensioning a series of deck slabs. A plurality of bogies traveling on the lower flanges of the bridge girders are provided to place and level the deck slabs and to pre-load the bridge girders to eliminate camber before placement of the deck slabs on the bridge girders or to level, place, support and remove deck forms for a cast-in-place deck slab on the bridge girders. Also provided is a system for attachment of cast-in-place parapets.

9 Claims, 16 Drawing Sheets

BRIDGE CONSTRUCTION SYSTEM AND METHOD

This application claims priority from U.S. Provisional application Ser. No. 60/633,525 ("the '525 application") filed Dec. 6, 2004. The '525 application is incorporated herein by reference.

This invention relates to a system and method for construction of bridges and elevated roadways with pre-cast pre-stressed concrete bridge girders or steel bridge girders and pre-cast pre-stressed concrete deck slabs or cast-in-place deck slabs, and, more particularly, to a system and method for placement of pre-cast pre-stressed concrete deck slabs on bridge girders with or without a cast-in-place deck topping or a forming system and method for cast-in-place deck slabs on bridge girders.

The majority of bridges constructed in the United States use concrete as the primary construction material and the use of pre-stressing has expanded the span capability of concrete bridges. The predominant method of deck or roadway construction on concrete bridges is full depth cast-in-place deck slabs. Another method is a full depth prefabricated deck system and a third is a combination of a partial depth pre-cast deck slab and a cast-in-place deck.

In very long continuous span bridges over bodies of water or low-lying wetlands and marshes, the only construction access may be from the bridge under construction. In other words, as the bridge is built, it serves as the route for delivery of materials, equipment and labor to the portion under construction. In certain coastal areas of the United States, particularly in wetlands, there may be no water access to the bridge construction site, thereby requiring that all construction materials, including bridge girders, piling, and concrete must be delivered over the completed portion of the bridge. Likewise, cranes and other equipment must be supported by and work from the completed end of the bridge. In addition to the problems inherent in water based bridge sites, access to the work site may also be limited in confined urban areas because of existing construction and right-of-way restrictions. Thus it can be seen that the faster each consecutive bridge span can be ready to carry a deck load the faster the bridge can be built. This is of particular importance in regions where seasonal climatic conditions are a factor. In emergency repair situations time is even more crucial.

Full depth cast-in-place deck slabs require forms constructed on site. Besides being labor intensive, this system requires access from under the bridge structure. Since, by the very nature of a bridge, land access is usually not available; any work done under a bridge deck requires extensive scaffolding. Perhaps the most serious drawback to this system is the time involved. Once the concrete is poured, a certain amount of time is needed to properly cure the concrete and then the forms must be removed, all of which must be done before the construction can proceed to the next section of the bridge span. This system is particularly unsuitable for continuous span bridge structures with limited or no access other than the bridge itself. However, there are situations where the cast-in-place deck slab is preferred.

As an alternative to full depth cast-in-place deck slabs, full depth pre-cast deck slabs have been used. Instead of pouring a deck in-place, full depth pre-cast deck slabs are brought to the bridge site and placed on the bridge girders to form a deck system with little or no concrete pouring. One disadvantage to this system is misalignment between adjacent panels due to variances in the elevation of the supporting bridge girders which makes it difficult to maintain a smooth road surface. Another disadvantage is the crane capacity needed to place a full depth pre-cast deck slab. If all construction materials and equipment must reach the construction site over the completed portion of a bridge, the weight of a full depth pre-cast deck slab needed to cover the next length of the bridge span along with the equipment needed to carry and place it may exceed the load capacity of the bridge. Thus it can be seen that full depth pre-cast deck slabs can be used under such conditions only if produced in smaller sizes. Unfortunately, this gives rise to an increased number of joints on the road surface with resultant problems in maintaining road smoothness.

Another alternative to full depth cast-in-place deck slabs is partial depth pre-cast pre-stressed deck slabs and a cast-in-place deck topping. These slabs are normally produced in relatively narrow widths and placed across the bridge girders in sequence. The smaller overall size allows these slabs to be transported directly to the site over the completed bridge roadway. This system provides the advantages of offsite prefabrication and overcomes the road surface smoothness problem inherent in full depth pre-cast deck slabs. In this system the partial depth pre-cast pre-stressed deck slabs serve as a form for a cast in place deck topping. However, because of variances in the elevation of the supporting bridge girders, and lack of continuity in the partial depth pre-cast pre-stressed deck slabs, the cast-in-place deck topping can develop "reflective" cracking outlining the pre-cast pre-stressed deck slabs below the deck topping.

Whether full depth or partial depth pre-cast pre-stressed deck slabs are used, problems in the deck or road surface depend to a great extent on the alignment of the deck slabs one to the next and the foundation upon which they rest. Part of the difficulty arises because of the way pre-stressed concrete bridge girders are made. When the pre-stressed tendons in a concrete girder are released after the concrete is poured, the girder takes a natural upward camber in the longitudinal direction. The girder will deflect when placed under load but there may be differences in deflection between adjacent girders. This has given rise to difficulties in alignment of deck slabs being installed on bridge girders with upward camber.

A system and method is needed for placement of pre-cast concrete deck slabs on bridge girders which overcomes the disadvantages in the prior art.

Likewise, a forming system and method for cast-in-place concrete deck slabs which overcomes certain of the disadvantages in the prior art is needed.

SUMMARY OF THE INVENTION

Accordingly, it is an object of this invention to provide a bridge construction system and method which is more cost efficient and easier to construct.

A further object of this invention is to provide a bridge construction system and method that is accomplished from the bridge deck level.

A further object of this invention is to provide a bridge construction system and method for forming and placing pre-cast pre-stressed concrete deck slabs, both full-depth and partial depth, on bridge girders wherein said bridge girders have a lower flange with at least one upper face.

A further object of this invention is to provide a bridge construction system and method for leveling a plurality of pre-cast pre-stressed concrete deck slabs, both full-depth and partial depth, before placement on bridge girders and that such system and method further comprise a plurality of bogies traveling on the upper faces of the lower flanges of the bridge girders.

A further object of this invention is to provide a bridge construction system and method for leveling, bracing and pre-loading bridge girders before placement of pre-cast pre-stressed concrete deck slabs, both full-depth and partial depth, and that such system and method further comprises a plurality of bogies traveling on the upper faces of the lower flanges of the bridge girders.

A further object of this invention is to provide a bridge construction system and method for post-tensioning pre-cast pre-stressed concrete deck slabs, both full-depth and partial depth, before placement on bridge girders.

A further object of this invention is to provide a bridge construction system and method for a cast-in-place deck topping over the post-tensioned pre-cast pre-stressed concrete deck slabs.

A further object of this invention is to provide pre-cast pre-stressed concrete deck slabs, both full-depth and partial depth, of sufficient strength at each end to support a cast-in-place parapet structure and to provide reinforcing bar extensions on each end of the pre-cast pre-stressed concrete deck slabs for a cast-in-place parapet structure.

A further object of this invention is to provide a bridge construction system and method for forming and placing cast-in-place deck slabs on bridge girders wherein said bridge girders have a lower flange with at least one upper face.

A further object of this invention is to provide a bridge construction system and method for placing, leveling, and supporting deck forms for cast-in-place deck slabs and such system and method further comprises a plurality of bogies traveling on the upper faces of the lower flanges of the bridge girders.

A further object of this invention is to provide a bridge construction system and method for leveling and bracing bridge girders before placing, leveling, and supporting deck forms for cast-in-place deck slabs and such system and method further comprises a plurality of bogies traveling on the upper faces of the lower flanges of the bridge girders.

It is a further object of this invention that the application of the bridge construction system and method not be limited to pre-stressed concrete bridge girders, but equally suitable for steel bridge girders or any combination of materials.

DETAILED DESCRIPTION OF THE INVENTION

Figure 1:
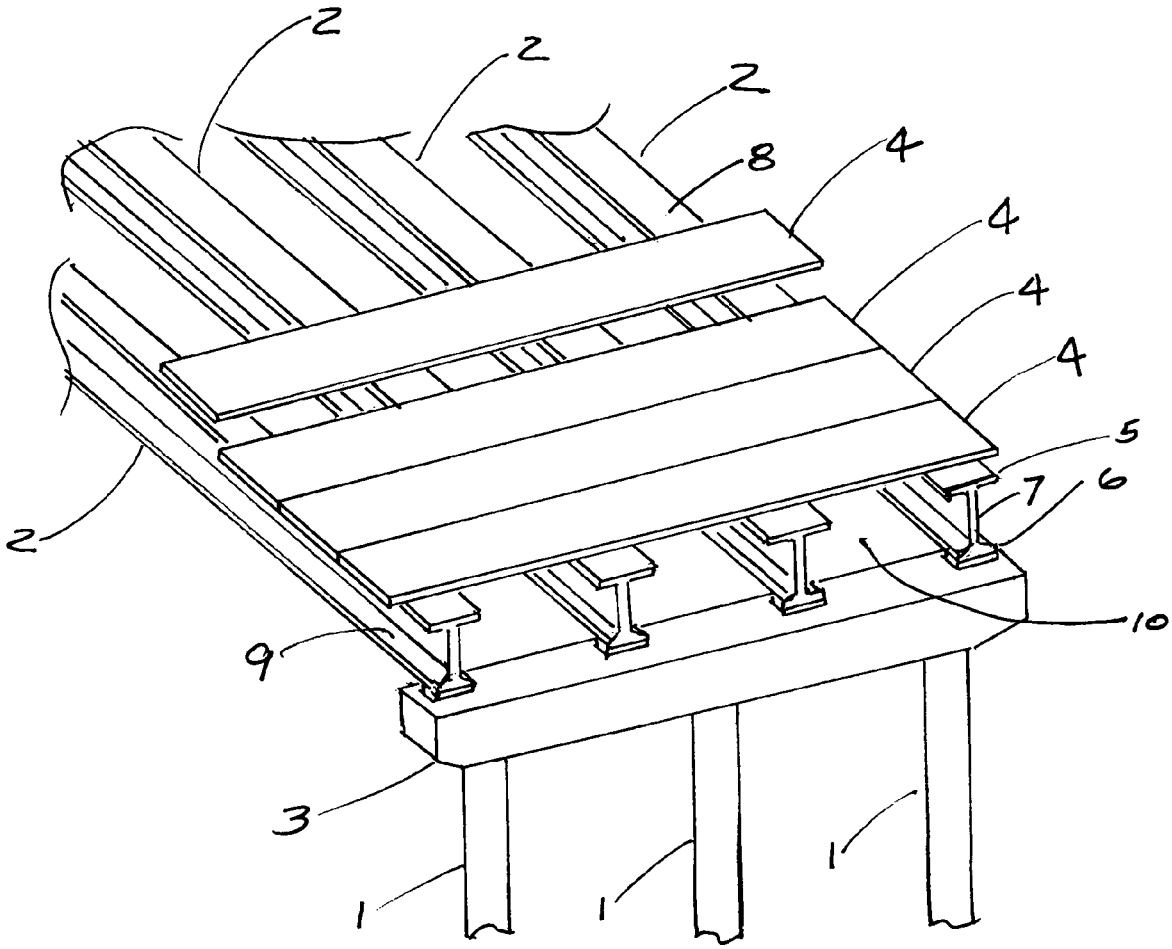
FIG. 1 is a perspective view of concrete bridge construction.

A typical concrete bridge construction is shown in FIG. 1, where the support pilings 1 are spaced in accordance with the designed span capability of the bridge girders 2 which are supported at the end of each span by a bent cap 3 resting on the support pilings 1. In the depicted embodiment the bridge girders 2 are pre-cast pre-stressed concrete. Although for many years the design of pre-cast pre-stressed concrete girders was based on compressive strengths of 5,000 to 6,000 psi, strengths up to 10,000 psi and above are now possible, giving rise to the term "high-performance concrete" (HPC). However, it is not intended that the present invention be limited to bridge construction using pre-cast pre-stressed concrete girders. A typical alternative would be a built-up steel plate girder.

As shown in FIG. 1, the bridge girders 2 have a typical cross section with an upper flange 5 and lower flange 6 connected by a vertical web 7. The upper flange 5 has an upper surface 8 which serves to carry the load imposed from above, where such load would include the weight of the deck and any road loads. Such load would also include the weight of wet concrete in the case of a cast-in-place deck, whether full or only a deck topping. Typically, the upper surface 8 of the upper flange 5 will be fitted with a series of metallic extensions commonly called shear connectors for attachment of the deck slabs whether pre-cast or cast-in-place. The lower flanges 6 of the bridge girders 2 have bottom surfaces which rest on the bent cap 3. The lower flanges 6 have upper surfaces 9. As shown in this embodiment the bridge girders 2 have a cross section symmetrical about the vertical axis of the web 7. Although of possibly different width, the upper flanges 5 and lower flanges 6 extend equally to the right and left. This type of configuration is known loosely as an "I" beam, but it understood that not all girders or beams are symmetrical in cross section nor is symmetrical cross section of girder necessary to the present invention.

As is well known in engineering, a beam or girder supported at both ends will deflect over its span when subjected to a load. The amount of deflection depends on many factors well known in the art, including for example in a uniform beam of homogenous material; span, load, moment of inertia of the beam cross section, end fixity, and modulus of elasticity of the beam material. Although the ability of a beam to support a load without failure is paramount, there are many design situations where the deflection of the beam is a significant factor. This is certainly true on bridges and elevated roadways where the deck surface must be level. A series of dips is unacceptable. For this reason, bridge girders are typically manufactured with camber or "reverse deflection" with the express intention that once loaded the girder will be level because the beam deflection is negated by the camber. In the case of pre-cast pre-stressed concrete girders, camber is achieved when pre-tensioned tendons running the length of the girder in the lower flange are released. Unfortunately, there may be differences in camber in adjacent beams and there may not be enough load to remove the camber, giving rise to a washboard effect or a slight hump over the girder span. The present invention solves that problem.

As can be seen in FIG. 1, there are openings 10 between the bridge girders 2 that are longitudinally continuous over the length of the bridge span between bent caps 3. These openings 10 are generally accessible from the bridge deck surface and it can also be seen that the upper surfaces 9 of the lower flanges 6 of the bridge girders 2 can serve as continuous riding surfaces for a wheel.

Also depicted in FIG. 1 are a series of pre-cast pre-stressed deck slabs 4 placed transversely across the bridge girders 2 with the bottom surface of the deck slabs 4 on the top surfaces 8 of the top flanges 5 to form a continuous deck panel. In FIG. 1 a single pre-cast pre-stressed deck slab 4 is shown suspended above the top surfaces 8 as it would be seen while being lowered by a crane into position. Pre-cast pre-stressed deck slabs 4 can be provided in full depth or partial depth and serve as the form for a final deck topping cast-in-place. The pre-cast pre-stressed deck slabs 4 shown in FIG. 1 have a transverse length sufficient to cover the design bridge width while being supported by all of the bridge girders 2, although other combinations are possible. For example, the bridge could be double lane on both sides of a center rail and the pre-cast pre-stressed deck slabs 4 could be provided in transverse lengths to cover one double lane.

Figure 2:
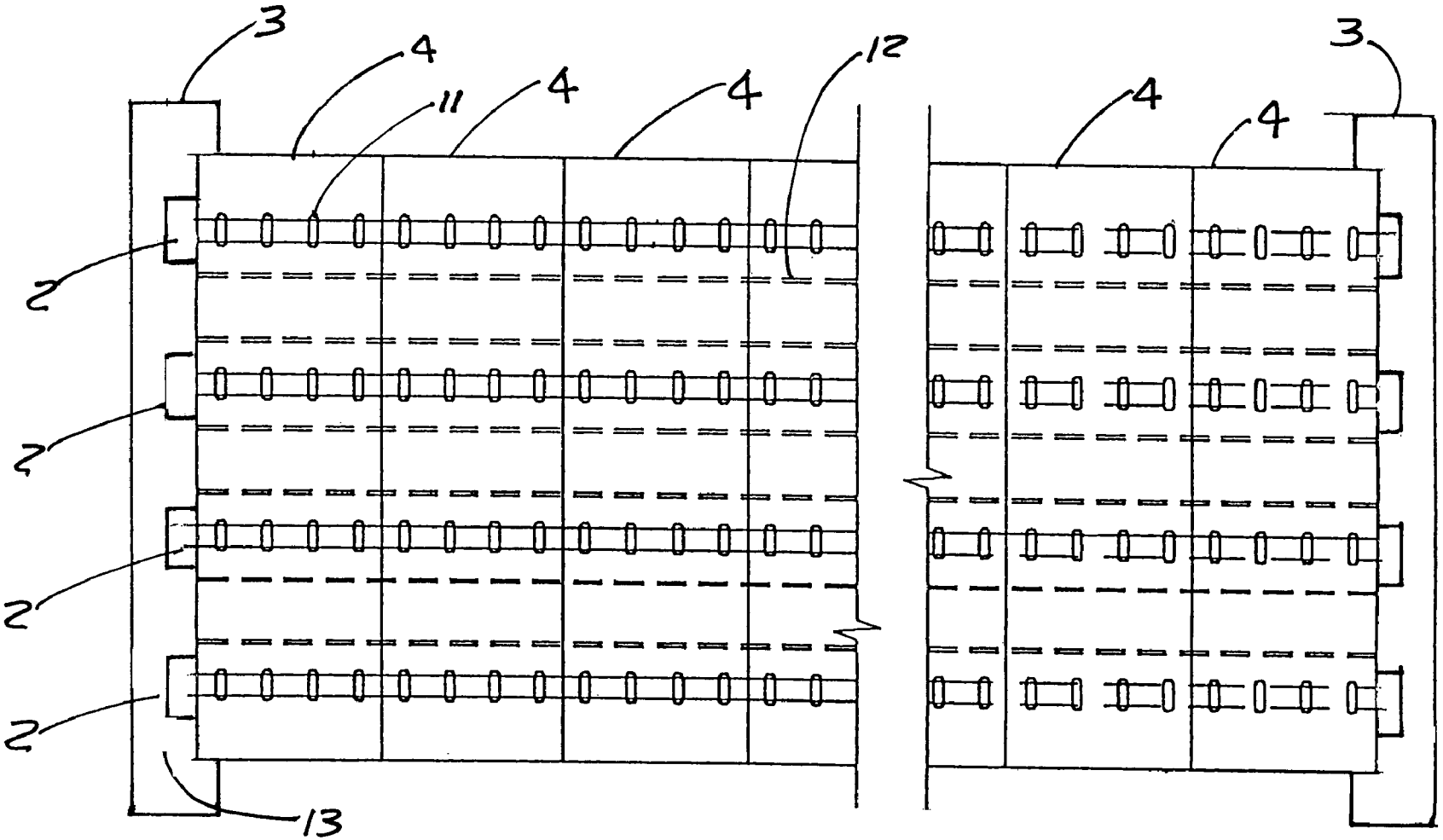
FIG. 2 is a plan view of a plurality of deck slabs in place on a bridge span.

FIG. 2 shows a plan view of a plurality of deck slabs 4 in place on bridge girders 2 over a bridge span between bent caps 3. In this embodiment, the deck slabs 4 have a nominal width of 8 feet and a transverse length of approximately 26 feet. In this depiction, the deck slabs 4 are partial-depth intended for a cast-in-place deck topping which is not shown in FIG. 2. However, deck slabs 4 can be full-depth and it is not intended the deck slabs 4 be limited to partial-depth. The deck slabs 4 are pre-cast with shear connector blockouts 11 for attachment of the deck slabs 4 to the bridge girders 2 supporting the deck slabs 4. Also shown in phantom are ducts 12 for post-tensioning tendons used to connect the plurality of deck slabs 4 extending over a bridge span between bent caps 3. It is intended that there be a gap 13 between the connected deck slabs 4 over a bridge span and the connected deck slabs 4 on each adjacent bridge for a cast-in-place closure pour.

Figure 3:
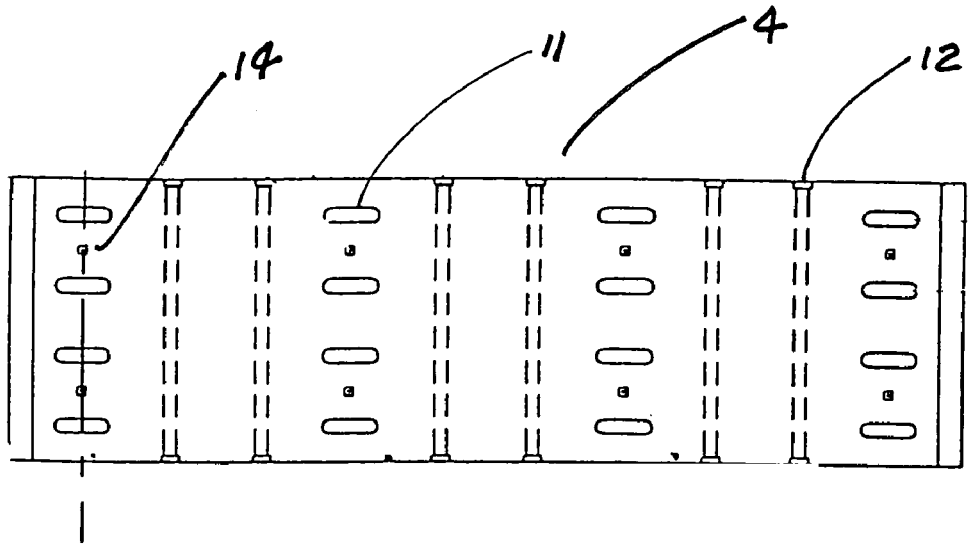
FIG. 3 is a plan view of a deck slab.

FIG. 3 is a plan view of a single pre-cast deck slab 4 with shear connector blockouts in alignment with the centerlines of the bridge girders. Also shown are optional leveling devices 14 and post-tensioning ducts 12. These deck slabs 4 would be pre-cast, pre-stressed, stockpiled and delivered to the construction site as needed.

Figure 4:
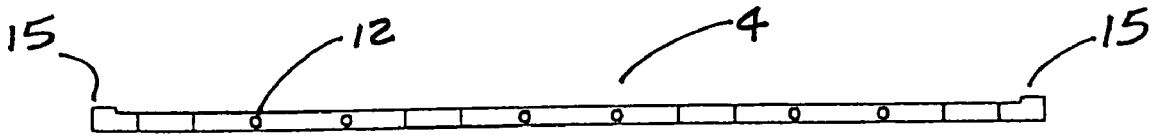
FIG. 4 is a side elevation of a deck slab.

FIG. 4 is a long side elevation of a single deck slab 4 as would be seen in a transverse cross section of the bridge. In this FIG. 4, the post-tensioning ducts 12 are depicted as well as a raised portion 15 at each end of the deck slab 4 intended to serve as a form for a cast-in-place deck topping approximately 2 inches in depth.

Figure 5:
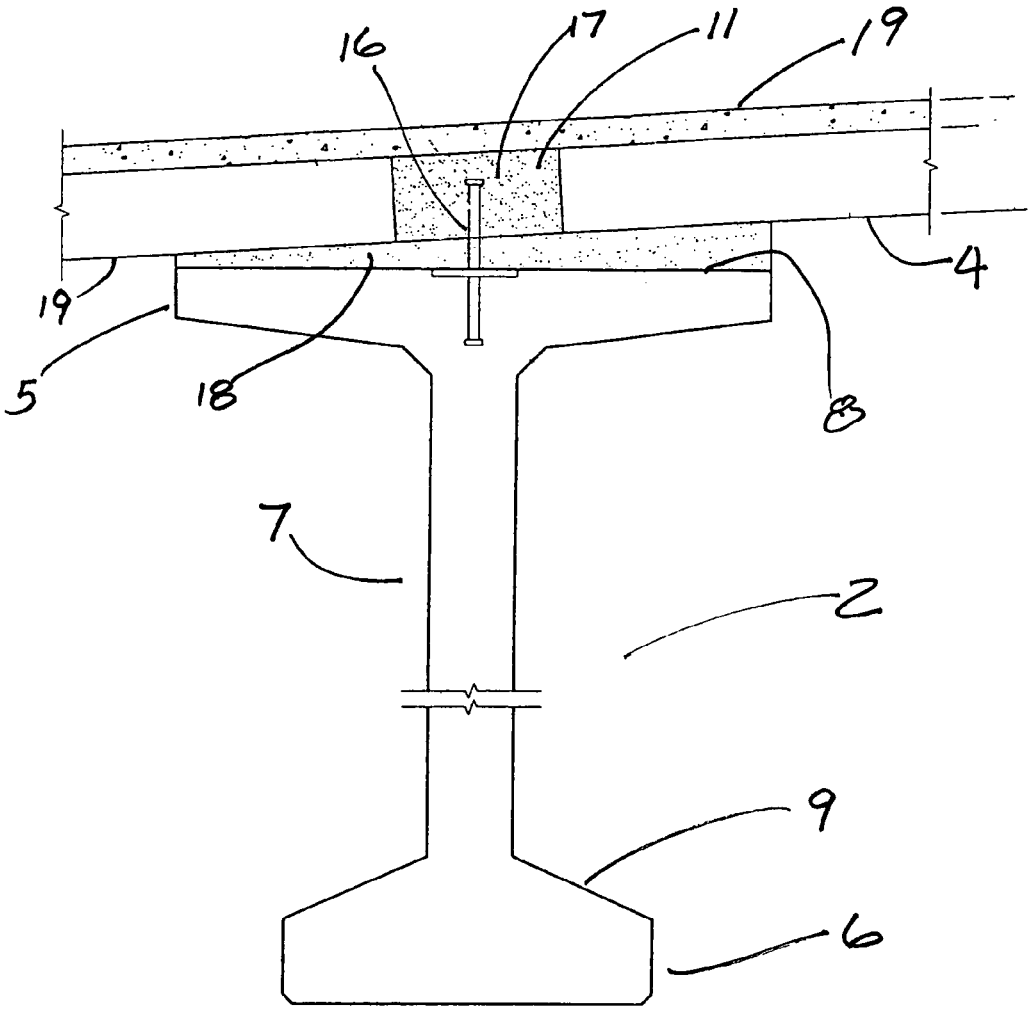
FIG. 5 is a cross section of a bridge girder at shear connector with deck slab.

FIG. 5 is a cross section of a bridge girder 2 at a shear connector 16 with a deck slab 4 in place on the upper surface 8 of the upper flange 5 of the bridge girder 2 with a shear connector blockout 11 over a shear connector 16 embedded in the upper flange 5. The shear connector 16 shown in FIG. 5 is depicted as an anchor stud but other configurations are possible. In FIG. 5, the shear connector blockout 11 has been filled with a suitable non-shrink pourable grout 17 which also is used to fill any voids 18 between the bottom surface 19 of the pre-cast slab 4 and the upper surface 8 of the upper flange 5 of the bridge girder 2, which voids 18 can be sealed by an elastomeric strip along the outer edges of the upper surface 8 of the upper flange 5. This strip, which is not shown, can be pre-installed on the precast slab or installed on site.

Also shown in FIG. 5 is a cross section of the cast-in-place deck topping 19, as well as the web 7 and lower flange 6 of the bridge girder 2, with upper surfaces 9.

Figure 6:
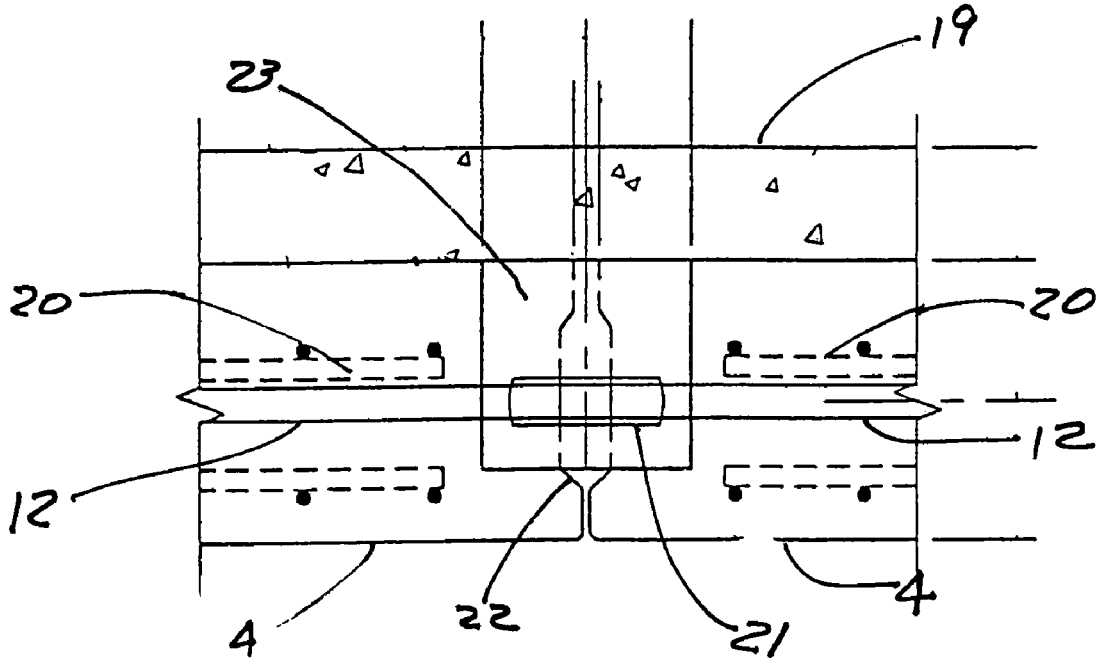
FIG. 6 is a section through a transverse deck joint at a post-tensioning duct.

FIG. 6 depicts a typical cross section of a transverse deck joint between two adjacent deck slabs 4 at a post-tensioning duct 12. In this cross section, typical deck slab reinforcement 20 is shown as well as the cast-in-place deck topping 19. A connector 21 is shown for connection between the post-tensioning duct 12 in one deck slab 4 and the next. A shear key indentation 22 is also shown along each side face of the deck slabs 4. Also shown is a blockout 23 for connection of the post-tensioning duct 12.

Figure 7:
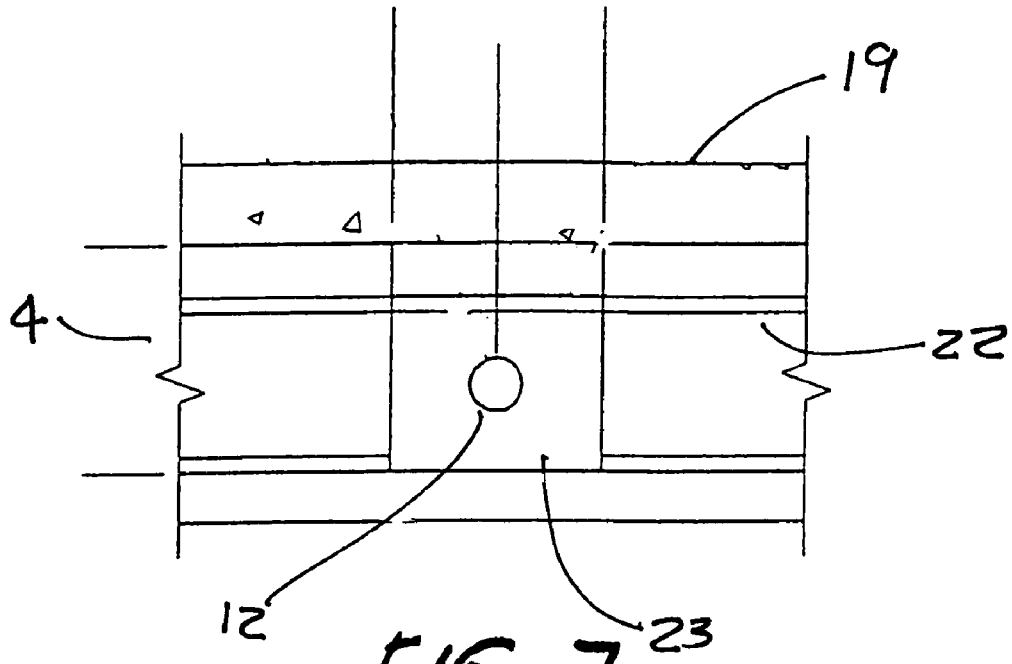
FIG. 7 is a section through the post-tensioning duct at a transverse deck joint.

FIG. 7 is a cross section through the post-tensioning duct 12 at a transverse deck joint with a blockout 23 for connection between the post-tensioning duct 12 in one deck slab 4 and the next. The post-tensioning duct 12 is depicted in FIG. 7 with a circular cross section and typically would be corrugated metal of approximately 1-2 inches in diameter. However, other materials such as polyethylene are suitable and the post-tensioning duct 12 could be of a cross section such as oblong rather than circular.

Figure 8:
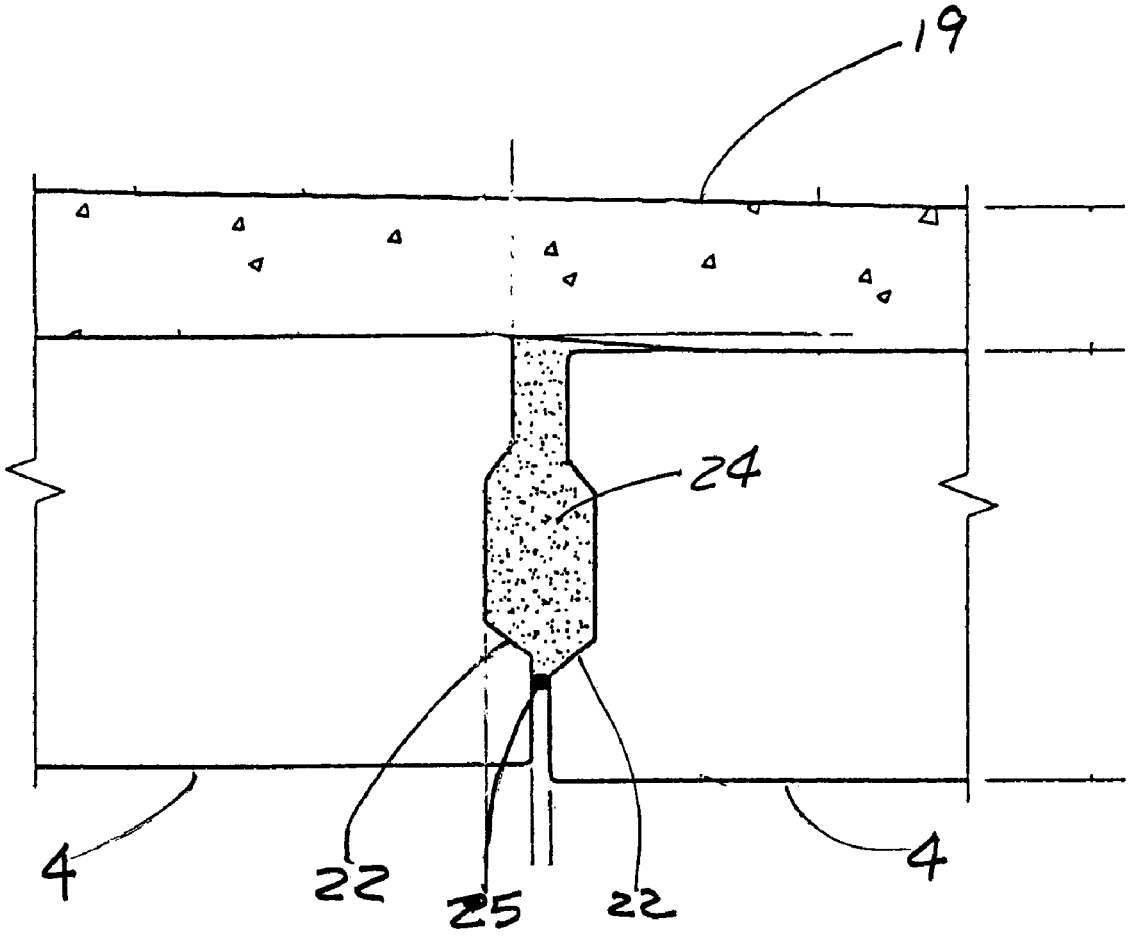
FIG. 8 is a section through a transverse shear key.

FIG. 8 depicts a typical shear key detail between two adjacent deck slabs 4. The shear key indentation 22 is filled with a non-shrink grout 24 after sealing the bottom of the longitudinal joint with a backer rod 25 that can be closed cell polyethylene foam. The cast-in-place deck topping 19 is also shown as poured over the top surface of the deck slabs 4.

Figure 9:
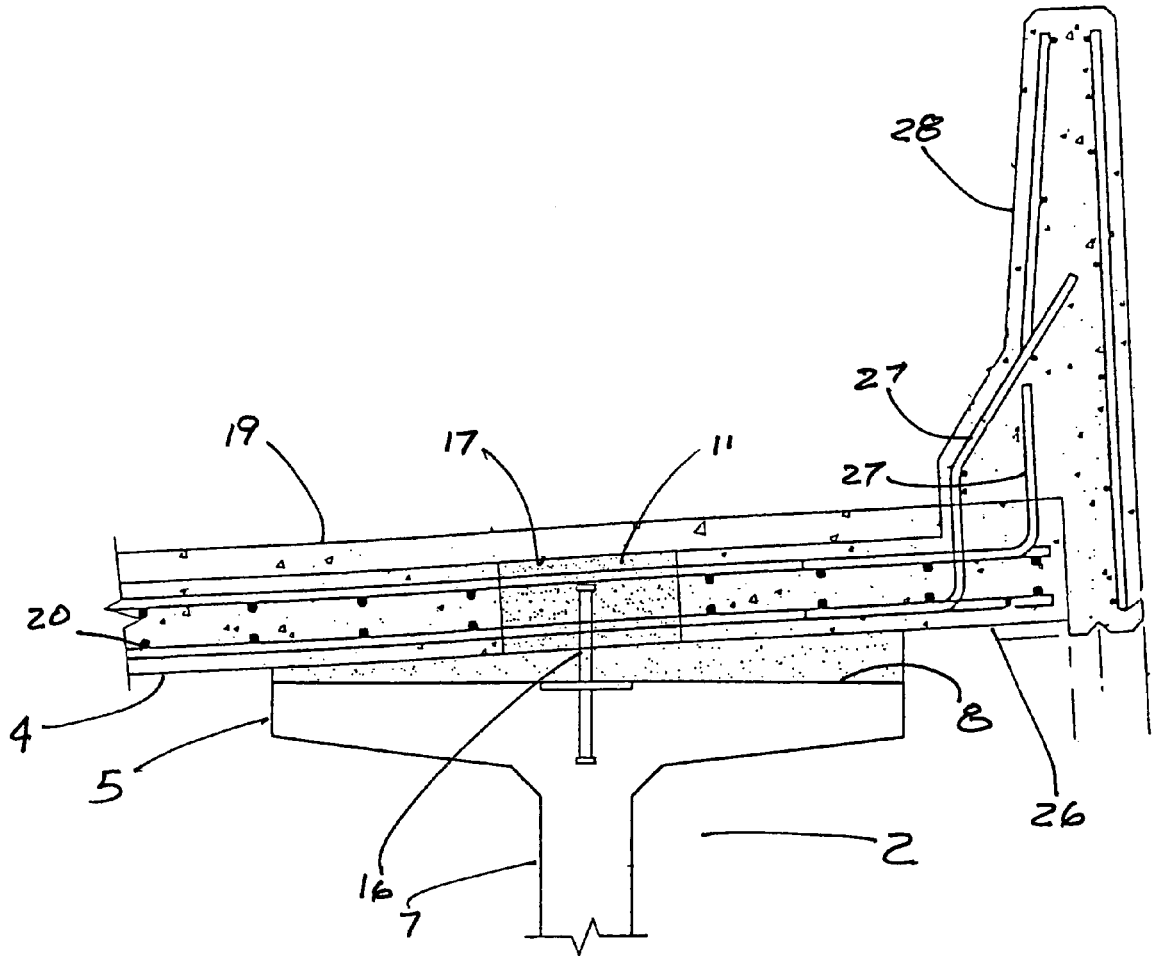
FIG. 9 is a cross section of deck slab at overhang with parapet connections.

FIG. 9 is a cross section of a bridge girder 2 at a shear connector 16 with an overhang portion 26 of a deck slab 4 in place on the upper surface 8 of the upper flange 5 of the bridge girder 2 with a shear connector blockout 11 over a shear connector 16 embedded in the upper flange 5. In this embodiment, the overhang portions 26 of the deck slabs 4 are provided with extended reinforcing bars 27 to provide support for a cast-in place concrete parapet 28 which can be continually cast without extensive forming.

Figure 10:
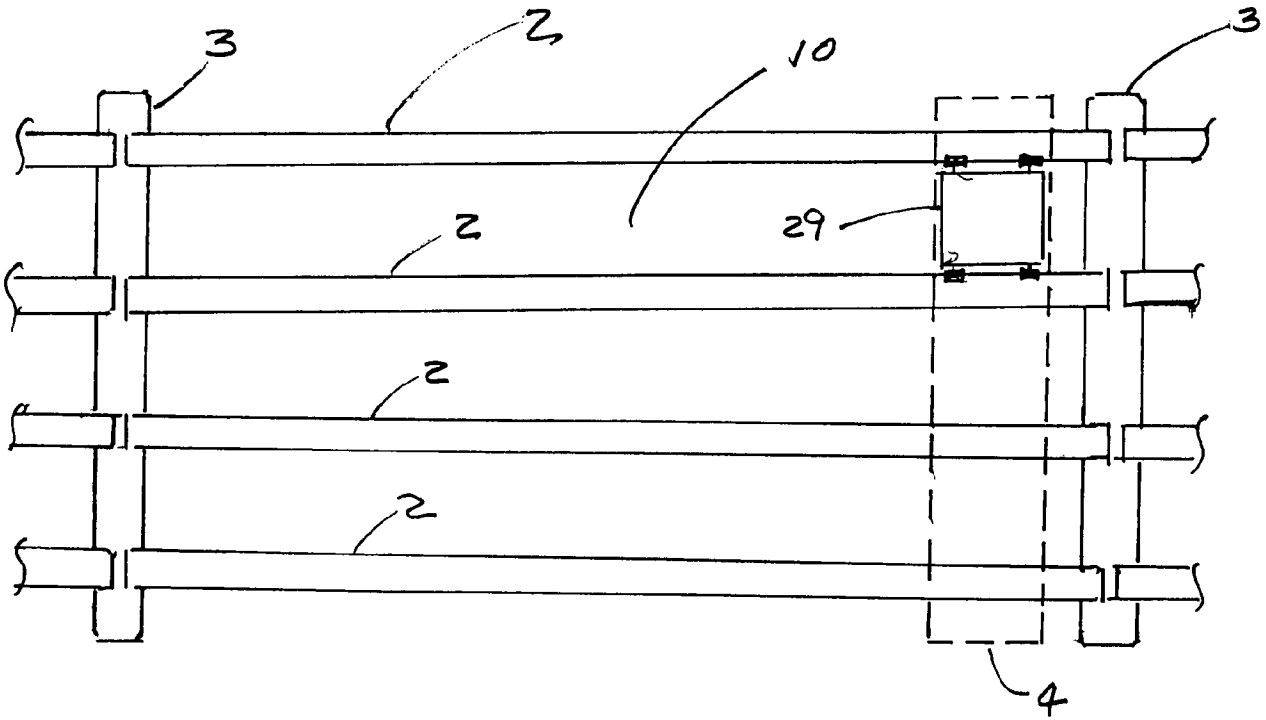
FIG. 10 is a plan view of bridge girders in place on bent caps set on piling supports.

FIG. 10 is a plan view of bridge girders 2 in place on bent caps 3 set on piling supports 1 before installation of a cast-in-place deck or pre-cast deck slabs. Also depicted in FIG. 10 is a bogie 29 in place between two bridge girders 2 with the bogie 29 riding on the upper surfaces 9 of the lower flanges 6 of the bridge girders 2. In this depiction, a single pre-cast deck slab 4 is shown in outline above the bogie 29. While not shown in FIG. 10, there would normally be at least one bogie 29 in each opening 10 between the bridge girders 2, with each bogie 29 working in tandem with the transversely adjacent bogies 29 to accomplish the inventive system and method. For example, the pre-cast deck slab 4 outlined in FIG. 10 would be transported and placed by three bogies 29 in line, each carrying a portion of the pre-cast deck slab weight.

Figure 11:
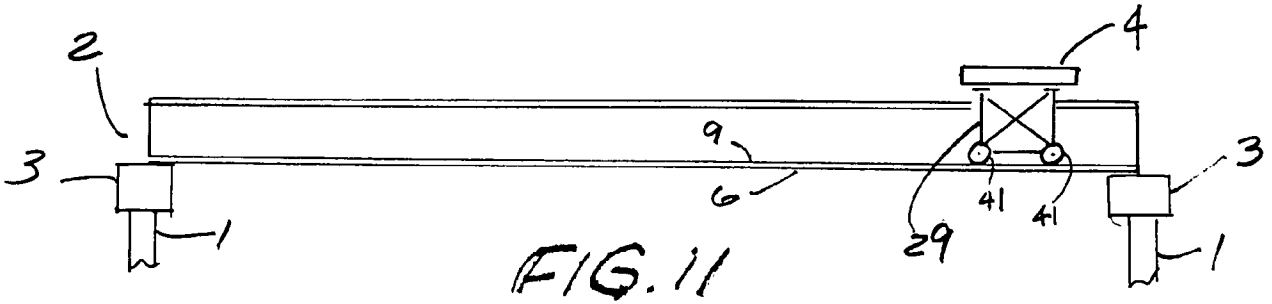
FIG. 11 is a side view of a bridge girder with a bogie in place.

FIG. 11 is a side elevation of a bridge girder 2 in position on bent caps 3 showing a cross section of a single bogie 29 in place with wheels 41 to travel along the upper surface 9 of the bridge girder lower flange 6. Also shown is a cross section of pre-cast deck slab 4 carried atop the bogie 29.

Figure 12:
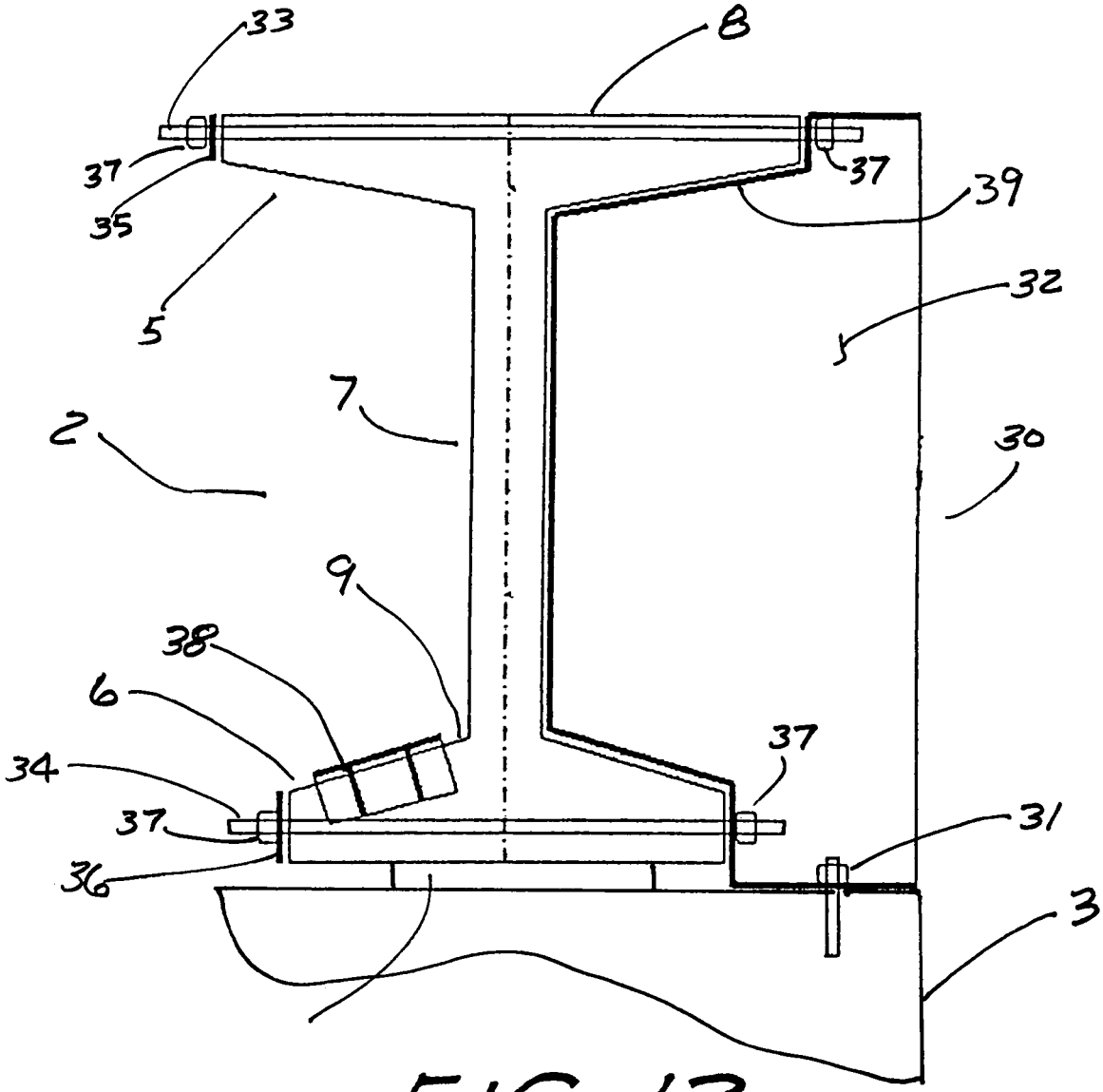
FIG. 12 is an end elevation of an outside bridge girder with girder bracing system detail.

FIG. 12 is a end view of an outside bridge girder 2 in place on a bent cap 3 with a girder bracing system 30 to maintain transverse stability and prevent displacement of the bridge girders during erection and to insure a uniform rolling surface for the wheels 41 of bogies 29 on the upper surfaces 9 of the bottom flanges 6. As can be seen in FIG. 12, the girder bracing system 30 is anchored in the bent cap 3 by bolts 31 or other suitable method. Stiffener plates 32 are provided in a backing piece 39 which may be made from a segment of girder form used to manufacture the bridge girders 2. The girder bracing system 30 is intended to traverse the bridge width with similar anchoring 31, backing pieces 39 and stiffener plates 32 in mirror image on the opposite outside bridge girder 2. An upper tie rod 33 which may be threaded will extend transversely from one outside bridge girder to the other outside bridge girder at the upper flange 5 and a lower tie rod 34 which may be threaded will extend transversely from one outside bridge girder to the other outside bridge girder at the lower flange 6. Stability and dimensional accuracy between the girders can be achieved by nuts 37 and upper clamping brackets 35 and lower clamping brackets 36 on each side of both the upper flanges 5 and lower flanges 6 of the bridge girders 2 respectively.

Also shown in FIG. 12 is a typical bogie wheel bridge 38 on the upper surface 9 of the lower flange 6 of the bridge girder 2 that is the riding surface for the bogie wheels 41. The bogie wheel bridge 38 is an extension of that riding surface which will allow a bogie 29 to cross from one bridge span to the next without any disassembly or reassembly.

Figure 13:
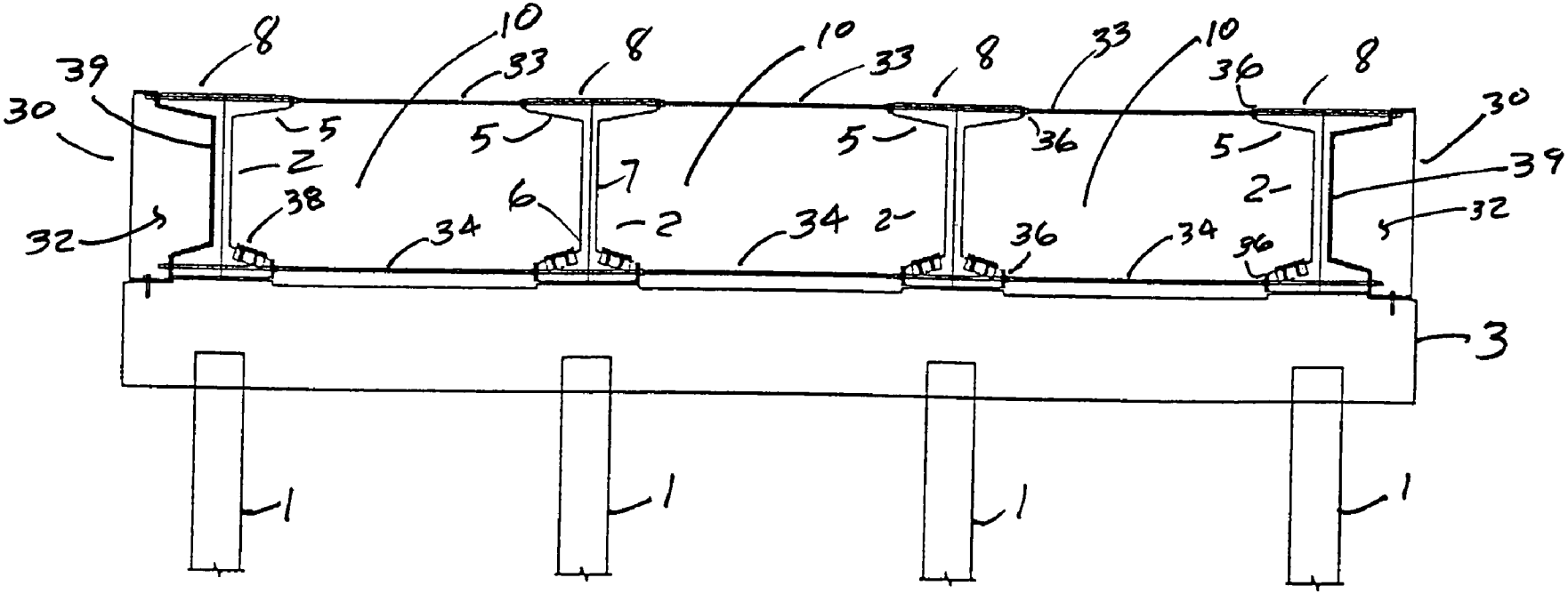
FIG. 13 is an end elevation of the girder bracing system across the bridge width.

FIG. 13 is an end elevation of the girder bracing system 30 across the bridge width extending from one outside girder to the other with upper tie rods 33 and lower tie rods 34 tensioned and clamps 35 and 36 tightened to their respective upper flange 5 and lower flange 6. FIG. 13 also depicts bogie wheel bridges 38 which will allow a bogie 29 to cross from one bridge span to the next. Also shown in FIG. 13 is the opening 10 between bridge girders 2 set on bent cap 3 resting on support pilings 1.

Figure 14:
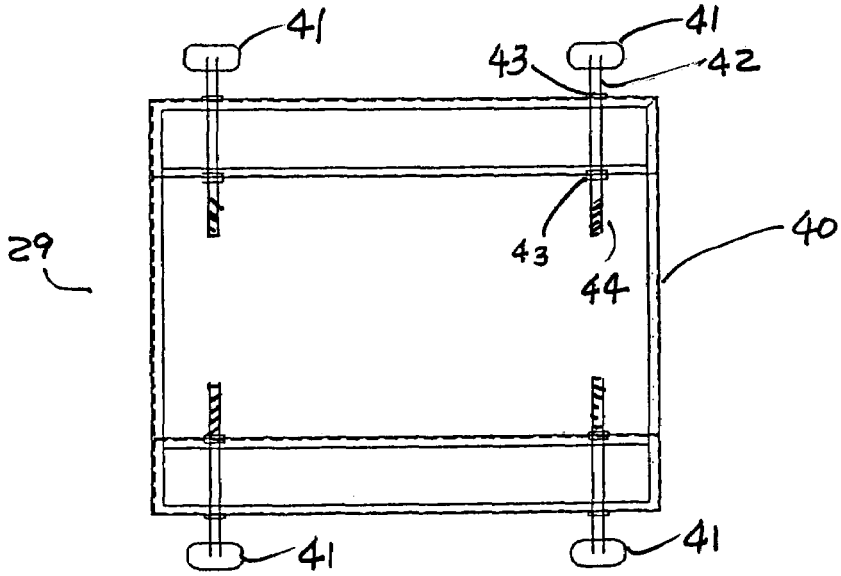
FIG. 14 is a plan view of a bogie.

FIG. 14 is a plan view of a bogie 29 depicting a frame 40 and wheels 41 mounted on axles 42 supported by bearings 43. The axles 42 can be adjusted or replaced to suit the spacing of the bridge girders 2. In this embodiment the bogie frame 40 is fabricated from channel sections of steel or other suitable material. The bogie wheels 41 can be forklift wheel assemblies with hub and bearing. In this depiction, the bogie 29 has four wheels 41 mounted on axles 42 with threaded ends 44 opposite the wheels 41 for adjustment of wheel track. While four wheels 41 are shown additional pairs of wheels could be used depending on the load requirements.

Figure 15:
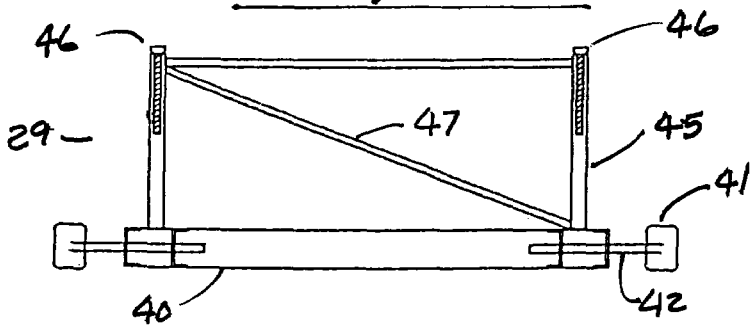
FIG. 15 is an end view of a bogie.

FIG. 15 is an end view of a bogie 29 with the bogie frame 40 carrying a scaffolding structure 45 with suitable cross bracing 47 for the carried load along with lifting devices 46 at each corner to raise and level the intended load. The lifting devices 46 can be manual or motor driven screw jacks as well as hydraulic cylinders. The lifting devices 46 can likewise be controlled remotely from a central control station apart from the bogies 29.

Figure 16:
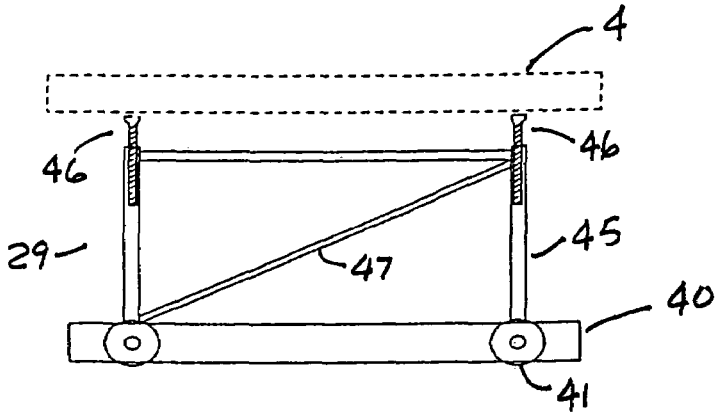
FIG. 16 is a side view of a bogie.

FIG. 16 is a side view of a bogie 29 with the bogie frame 40 carrying a scaffolding structure 45 with suitable cross bracing 47 for the carried load along with lifting devices 46 at each corner to raise and level the intended load. In FIG. 16 is also shown the outline of a pre-cast slab 4 supported by the lifting devices 46 in an elevated position. Rollers may be installed on the lifting faces of the lifting devices 46 to allow for transverse positioning of the pre-cast slabs 4.

While not shown, movement of the bogies 29 may be accomplished by an external driving means such as winch and cable or crane.

Figure 17:
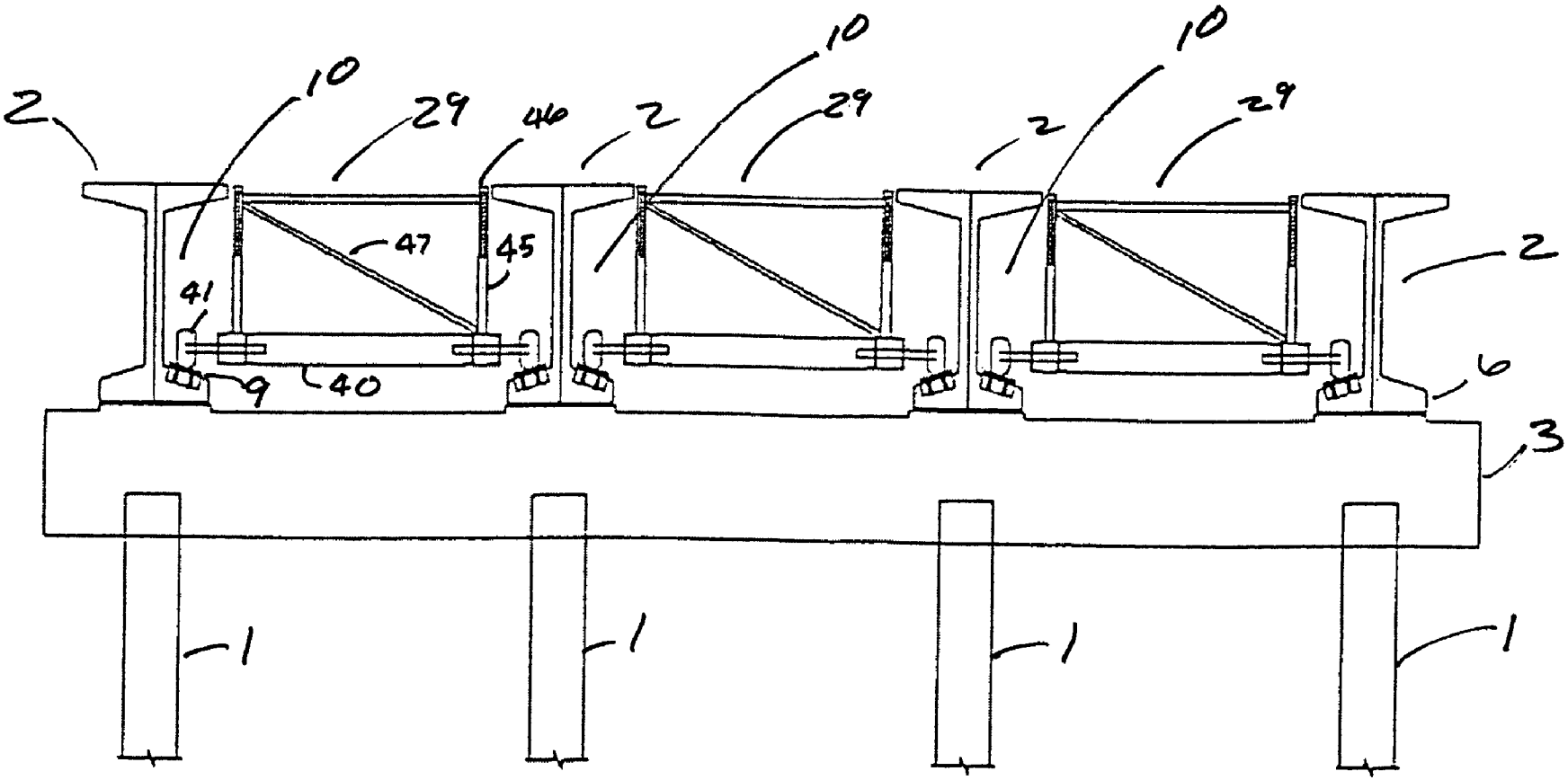
FIG. 17 is an end elevation of the bridge girders at the bent cap with bogies in position.

FIG. 17 is an end elevation of the bridge girders 2 at the bent cap 3 with bogies 29 in each opening 10 having bogie wheels 41 riding on the upper surfaces 9 of the lower flanges 6 of the bridge girders 2. As depicted in FIG. 17, the lifting devices 46 mounted on the bogies 29 are retracted allowing span to span movement of the bogies 29.

Figure 19:
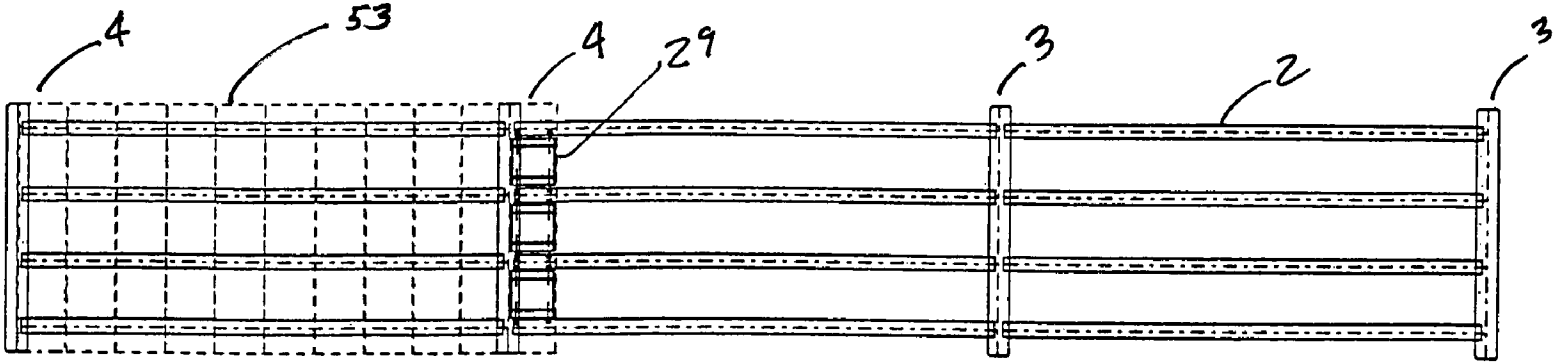
FIG. 19 is plan view of the inventive system and method over adjacent bridge spans at the start of a new span.
Figure 18:
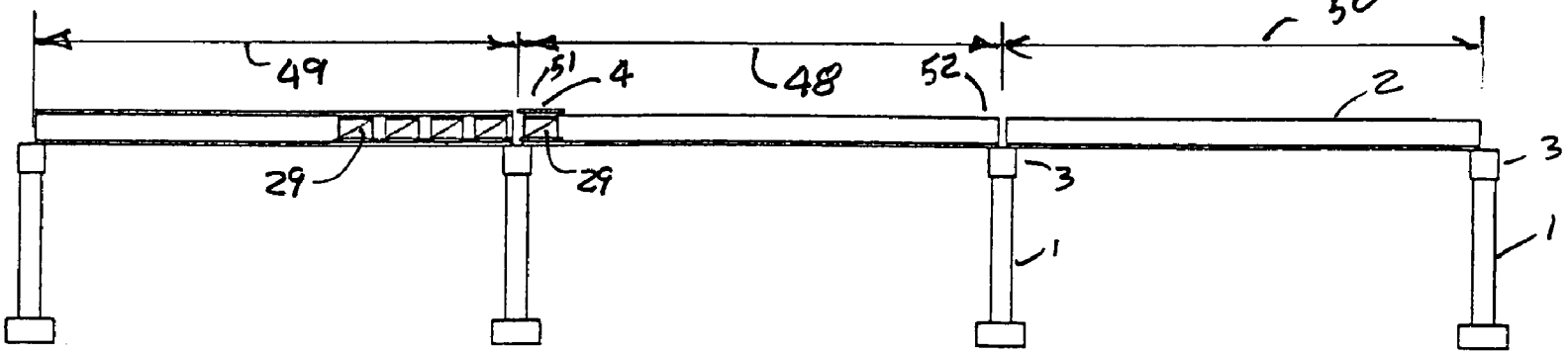
FIG. 18 is an elevation of the inventive system and method over adjacent bridge spans at the start of a new span.

FIG. 18 is an elevation and FIG. 19 is a plan view of the inventive system and method over adjacent bridge spans starting on bridge span 48 using pre-cast deck slabs 4 with construction proceeding from left to right. In the left span 49 all of the pre-cast slabs have been rolled into position on bogies 29, leveled, joints grouted and post-tensioned while still on the bogies 29 to form a pre-cast post-tensioned unit 53 and then lowered onto the bridge girders 2 by the bogie leveling devices 46 and affixed to the bridge girders.

As shown in FIG. 18, a series of bogies 29 are lined up under the previously placed set of pre-cast slabs on span 49, in position to move onto span 48, while a line of bogies 29 is shown on the beginning end 51 of span 48 supporting a pre-cast slab 4 in an elevated position ready to be rolled to the right end 52 of span 48. As can be seen, the lifting devices 46 on the bogies 29 can elevate the pre-cast deck slab above the shear connectors or any other structures extending above the upper surface 8 of the upper flange of the bridge girders 2 while the pre-cast deck slab is carried by a set of bogies 29 to position. As can also be seen, once the first line of bogies 29 on span 48 begins to transport a pre-cast slab 4 toward the right end 52 of span 48, the next line of bogies 29 lined up under the previously placed set of pre-cast slabs on span 49 can be rolled onto the beginning end 51 of span 48 over bogie wheel bridges 38 as shown in FIGS. 12 and 13. Once in position at the beginning end 51 of span 48, this next line of bogies 29 can then receive a pre-cast slab 4 to be transported behind the preceding one.

Figure 21:
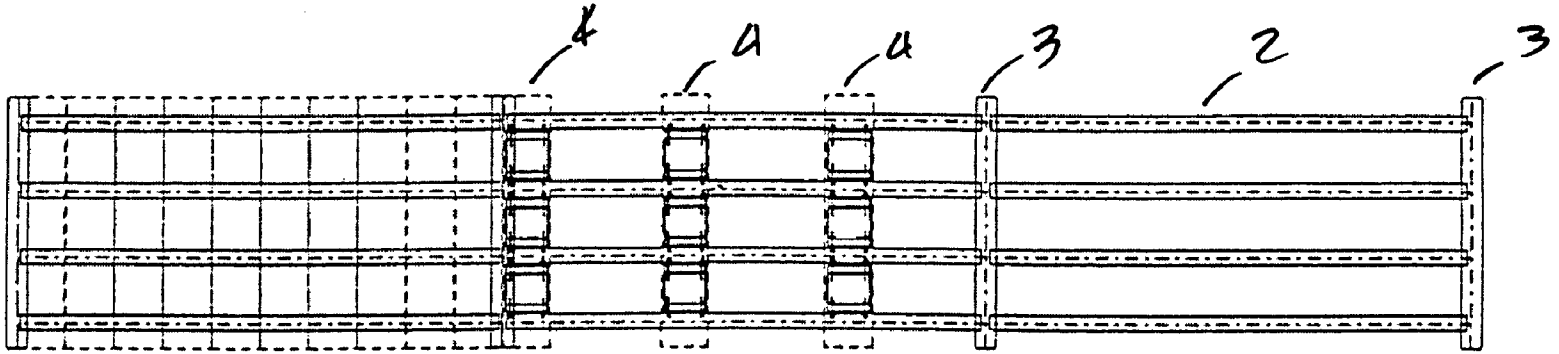
FIG. 21 is plan view of the inventive system and method over adjacent bridge spans with pre-cast slabs being moved into position.
Figure 20:
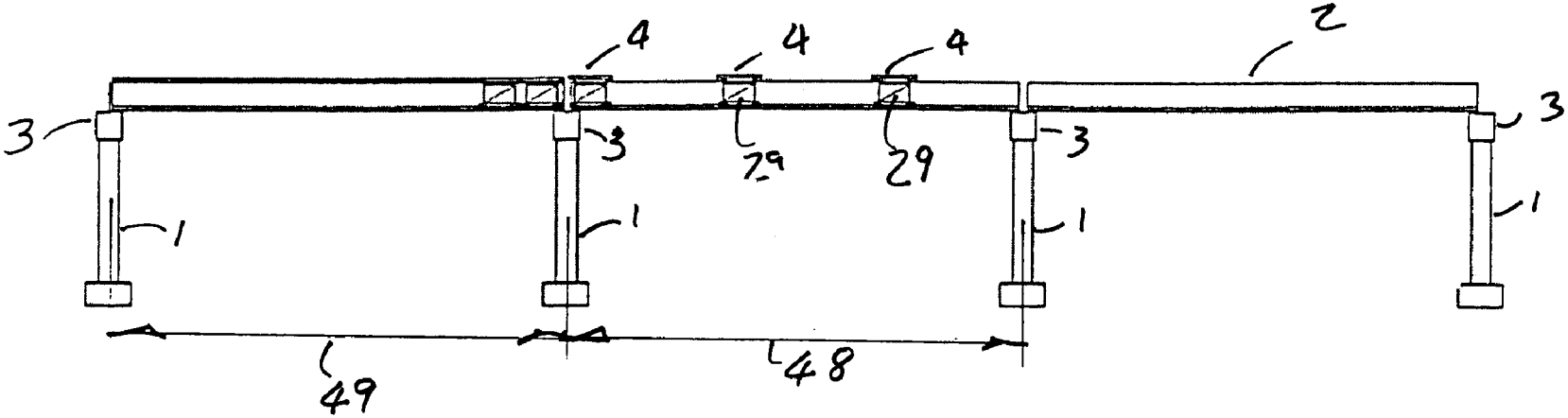
FIG. 20 is an elevation of the inventive system and method over adjacent bridge spans with pre-cast slabs being moved into position.

FIG. 20 is an elevation and FIG. 21 is a plan view of the inventive system and method over adjacent bridge spans which illustrate a series of pre-cast slabs 4 being moved into position on span 48 by bogies 29.

Figure 23:
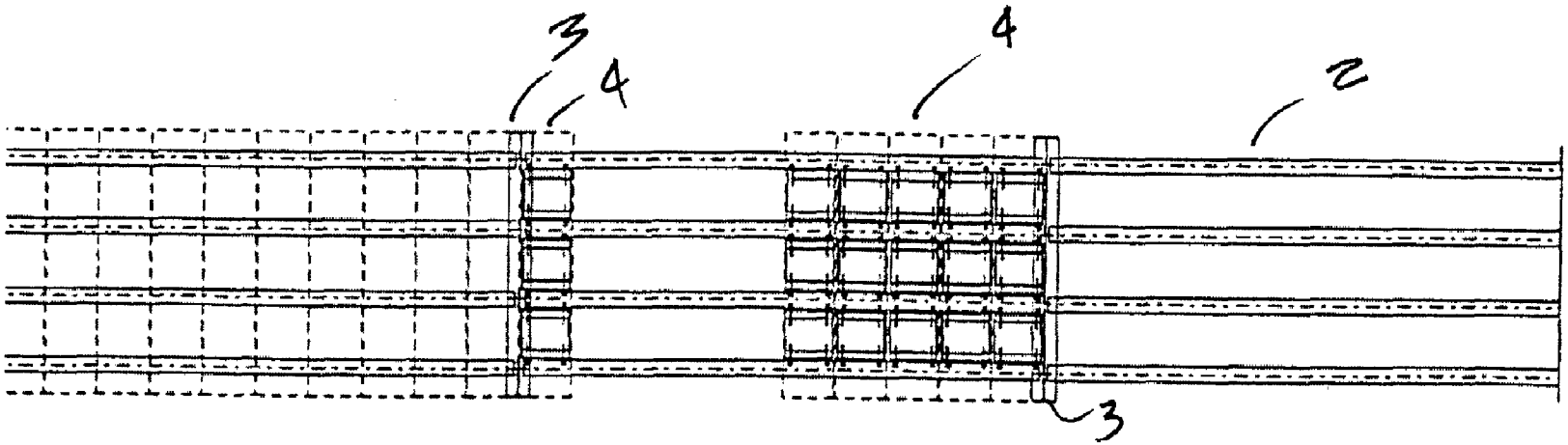
FIG. 23 is plan view of the inventive system and method over adjacent bridge spans with a partially filled span.
Figure 22:
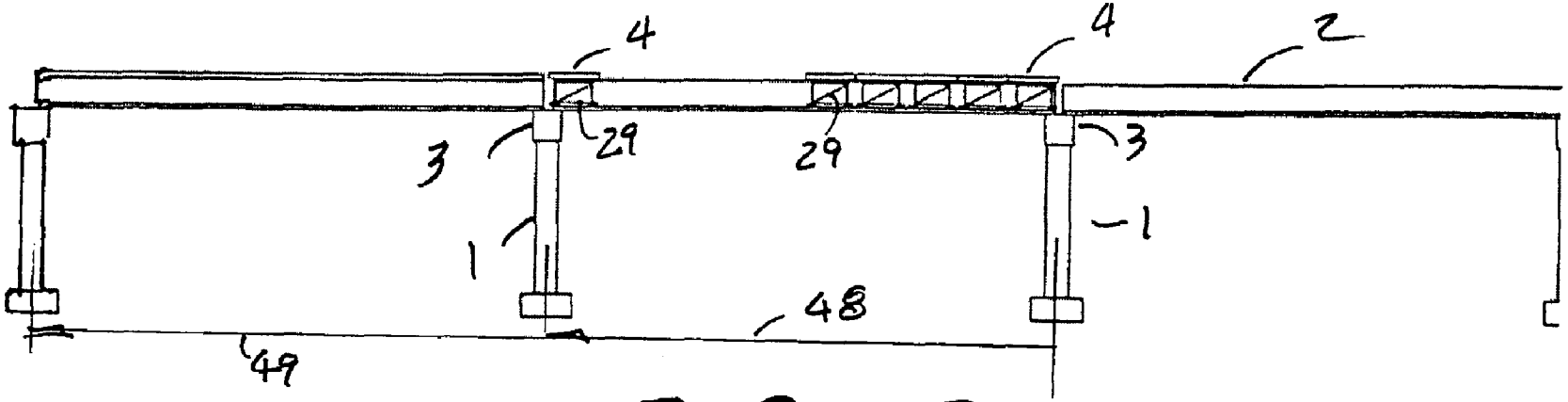
FIG. 22 is an elevation of the inventive system and method over adjacent bridge spans with a partially filled span.

FIG. 22 is an elevation and FIG. 23 is a plan view of the inventive system and method over adjacent bridge spans which illustrate a span 48 partially filled with pre-cast slabs 4, being supported by bogies 29.

Figure 25:
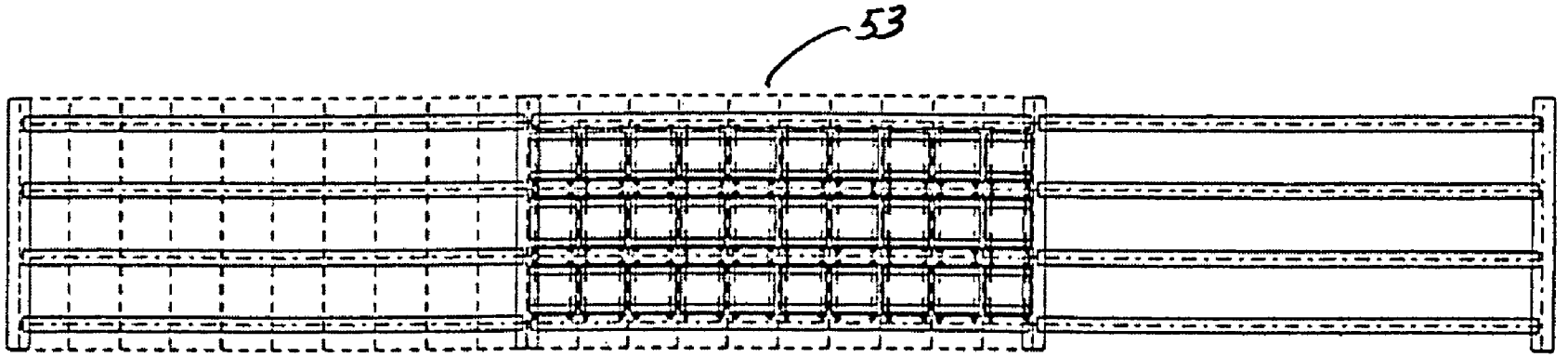
FIG. 25 is plan view of the inventive system and method over adjacent bridge spans with a full pre-cast span unit in place.
Figure 24:
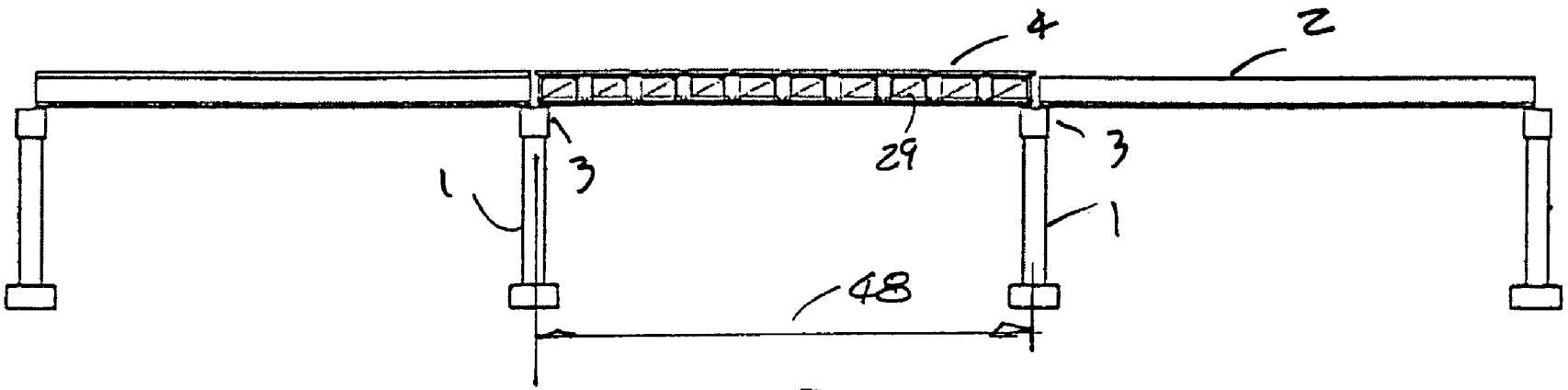
FIG. 24 is an elevation of the inventive system and method over adjacent bridge spans with a full pre-cast span unit in place.

FIG. 24 is an elevation and FIG. 25 is a plan view of the inventive system and method over adjacent bridge spans which illustrate a full pre-cast pre-tensioned unit 53 in place on span 48, having been leveled, joints grouted and post-tensioned while still on the bogies 29 and then lowered onto the bridge girders 2 by the bogie leveling devices 46 and affixed to the bridge girders.

The system and method illustrated in FIGS. 18 through 25 would be repeated for the next open span.

Using the lifting devices 46 on each bogie, the plurality of deck slabs 4 covering a bridge span can be leveled and post-tensioned as a pre-cast unit 53 covering the entire bridge span using pre-cast post-tensioning ducts 12 and tendons as depicted in FIGS. 2, 3, 4, 6 and 7. The post-tensioned and level unit 53 of deck slabs can now be lowered by the bogie lifting devices 46 onto the bridge girders with shear connectors being received in pre-cast shear connector blockouts. Once placed on the bridge girders, a cast-in-place topping can be poured after suitable grouting of the shear connector blockouts. As an alternative to conventional shear connectors 16 the unit 53 may be bonded to the upper surface 8 of the bridge girder 2 by high-slump concrete or a combination of methods.

By placing all deck slabs for a bridge span on bogies before leveling and post-tensioning, the bridge girders will deflect with the resultant elimination of camber. In effect, the bridge girders are pre-loaded and leveled before the deck slabs are set. Since the upper surface of the bridge girders will be flat, bonding of the unit 53 by high-slump concrete becomes feasible.

While the embodiment shown in FIGS. 18 through 25 depicts the placement of pre-cast deck slabs 4, the inventive system and method is equally suited to use for a cast-in-place deck. Although there are delays inherent in using a cast-in-place deck because of the cure time, there are situations where it still must be used and the present invention affords a more efficient and economical system. By using sets of bogies 29 in configuration similar to that used to place, level and set pre-cast deck slabs 4, the bogies 29 can be used to carry and suspend conventional deck forming panels for conventional cast-in-place construction during pouring and curing of the concrete. After the concrete has cured, the forms can be lowered onto the bogies 29 and moved to the next set of spans, allowing multiple spans to be cast without the use of barges, scaffolding or SIP forms and diaphragms need not be full depth. The bogies 29 can also be used to ferry supplies to the end of the bridge before placing the deck.

The girder bracing system shown in FIGS. 12 and 13 can be used with conventional SIP forming systems, thus avoiding the need to remove cross bracing under cast-in-place decks.

Although the inventive system and method partly comprises pre-cast pre-stressed deck slabs 4 used in combination with bogies 29 and a girder bracing system 30, it is intended that the pre-cast pre-stressed deck slabs 4 can be used and installed by conventional methods such as placement by crane. In such an installation, the plurality of deck slabs 4, after being set in place by a crane over a bridge span would be leveled by optional leveling devices 14 through leveling blockouts cast in the deck slabs 4. Once level, the post-tensioning ducts 12 would be spliced with a connector 21 between adjacent deck slabs 4 and stressing tendons would be threaded through the ducts 12. The joints between adjacent deck slabs would be sealed with a backer rod 25 and then all joints and handholes would be filled with a non-shrink grout. The stressing tendons would then be tensioned and grouted. At this point, anchor studs would be suitably welded or attached to shear connectors 6 in the bridge girders 2 and all blockouts filled with suitable non-shrink pourable grout. If the deck slabs 4 were partial-depth, the cast-in-place deck topping 19 would be installed last, although multiple spans could be poured at one time.

When used in used in combination with bogies 29 and a girder bracing system 30, the deck slabs 4 would be placed on bogies 29 by crane or other lifting device and rolled to the far side of the span as described above and illustrated in FIGS. 18 through 25. Once the span is filled with deck slabs 4, the deck slabs 4 are leveled on the bogie lifting devices 46, the joints between deck slabs 4 are grouted as described above and the entire plurality of deck slabs 4 are longitudinally post-tensioned by tendons as described above to create a unit 53 while resting on the bogies 29. Once the required build-up is field verified, forms are placed between the bridge girder 2 top flange 5 and the unit 53 to create a void. Once the grouted joints are cured, the unit 53 is lowered into place and bonded to the bridge girder upper flange 5 by high-slump concrete placed in the formed void through inlets such as shear connector blockouts 11 cast in the deck slabs 4. Bonding would be obtained by cohesion. Conventional shear studs would be used near the girder ends in combination with the bonding technique or as an alternative. Once the high-slump concrete cures, the deck can be loaded. The bogies 29 can be lowered and moved to the next span almost immediately with construction traffic allowed in as little as one day.

The invention claimed is:

1. A method for the construction of bridges with concrete decks and at least two longitudinally adjacent bridge girders with a span between support pilings, each with a longitudinal axis, where the concrete decks comprise pre-cast concrete deck slabs with post-tensioning ducts and have a bottom surface, the bridge girders each have a top flange with a top surface and a bottom flange with at least one upper face and where the top surface of the top flange of the bridge girders provides support to the bottom surface of the concrete decks and wherein said method comprises the steps of:

a. placing bogies with lifting devices between adjacent bridge girders to longitudinally travel on the upper faces of the lower flanges of the bridge girders;

b. transversely placing pre-cast deck slabs with post-tensioning ducts on the lifting devices of the bogies where the bottom of the deck slabs is above the top surface of the top flange of the bridge girders;

c. longitudinally moving bogies with transversely positioned pre-cast deck slabs on lifting devices to a final position on the span above the bridge girders;

d. repeating the above steps until all transversely positioned pre-cast deck slabs on lifting devices have been moved to their final position on the span above the bridge girders;

e. leveling all transversely positioned pre-cast deck slabs in their final position on the span above the bridge girders with the lifting devices on their respective bogies;

f. post-tensioning all transversely positioned pre-cast slabs in their final position on the span above the bridge girders with the lifting devices on their respective bogies;

g. lowering the leveled, post-tensioned pre-cast deck slabs as a unit onto the top surface of the top flange of the bridge girders with the lifting devices; and h. fixedly attaching the leveled, post-tensioned pre-cast deck slabs as a unit to the top surface of the top flange of the bridge girders.

2. The method of claim 1 further comprising the first step of transversely bracing the bridge girders to maintain transverse stability and prevent displacement of the bridge girders.

3. The method of claim 2 where the step of transversely bracing the bridge girders further comprises the steps of installing stiffener plates on a side of the bridge girders which does not face an adjacent bridge girder; installing upper and lower tie rods to transversely connect the upper and lower flanges of adjacent bridge girders respectively, and tensioning and locking said tie rods to maintain transverse stability and prevent displacement of the bridge girders.

4. The method of claim 1 where the pre-cast deck slabs further comprise an overhang portion to support a parapet.

5. The method of claim 2 where the pre-cast deck slabs further comprise an overhang portion to support a parapet.

6. The method of claim 3 where the pre-cast deck slabs further comprise an overhang portion to support a parapet.

7. A method for the construction of bridges with cast-in-place concrete decks and at least two longitudinally adjacent bridge girders with a span between support pilings, each with a longitudinal axis, where the concrete decks have a bottom surface, the bridge girders each have a top flange with a top surface and a bottom flange with at least one upper face and where the top surface of the top flange of the bridge girders provides support to the bottom surface of the concrete decks and wherein said method comprises the steps of:

a. placing bogies with lifting devices between adjacent bridge girders to longitudinally travel on the upper faces of the lower flanges of the bridge girders;

b. placing concrete deck forms for the cast-in-place concrete deck on the lifting devices of the bogies;

c. longitudinally moving bogies with concrete deck forms for the cast-in-place concrete deck on the lifting devices to a final position on the bridge girder span;

d. repeating the above steps until all concrete deck forms for the cast-in-place concrete deck on the lifting devices have been moved to their final position on the bridge girder span;

e. placing all concrete deck forms for the cast-in-place concrete deck on the lifting devices to their final position between the bridge girders;

f. casting and curing the concrete deck in the forms while still supported by the lifting devices on the bogies;

g. lowering the deck forms from the cast-in-place concrete deck with the lifting devices on the bogies and longitudinally moving the bogies away from the cast-in-place concrete deck.

8. The method of claim 7 further comprising the first step of transversely bracing the bridge girders to maintain transverse stability and prevent displacement of the bridge girders.

9. The method of claim 8 where the step of transversely bracing the bridge girders further comprises the steps of installing stiffener plates on a side of the bridge girders which does not face an adjacent bridge girder; installing upper and lower tie rods to transversely connect the upper and lower flanges of adjacent bridge girders respectively, and tensioning and locking said tie rods to maintain transverse stability and prevent displacement of the bridge girders.

* * * * *